US012157628B1

(12) United States Patent
Miller et al.

(10) Patent No.: US 12,157,628 B1
(45) Date of Patent: Dec. 3, 2024

(54) SYSTEMS AND METHODS FOR PURGING SMOKE OR OTHER GASSES FROM CONTAINERS

(71) Applicant: Energy Storage Response Group LLC, Delaware, OH (US)

(72) Inventors: Edward Miller, Delaware, OH (US); Nick Warner, Delaware, OH (US); Thomas Bensen, Delaware, OH (US)

(73) Assignee: Energy Storage Response Group LLC, Delaware, OH (US)

( * ) Notice: Subject to any disclaimer, the term of this patent is extended or adjusted under 35 U.S.C. 154(b) by 317 days.

(21) Appl. No.: 17/665,091

(22) Filed: Feb. 4, 2022

Related U.S. Application Data

(60) Provisional application No. 63/255,207, filed on Oct. 13, 2021, provisional application No. 63/166,087, filed on Mar. 25, 2021.

(51) Int. Cl.

| | |
|---|---|
| ***B65D 88/74*** | (2006.01) |
| ***F24F 7/06*** | (2006.01) |
| ***F24F 11/00*** | (2018.01) |
| *F24F 7/00* | (2021.01) |

(52) U.S. Cl.
CPC ..... *B65D 88/745* (2013.01); *F24F 7/065* (2013.01); *F24F 11/0001* (2013.01); *F24F 2007/001* (2013.01)

(58) Field of Classification Search
CPC ..... B55D 88/745; F24F 7/065; F24F 11/0001; F24F 2007/001
USPC ..... 454/64, 341
See application file for complete search history.

(56) References Cited

U.S. PATENT DOCUMENTS

| | | | | |
|---|---|---|---|---|
| 3,766,844 | A * | 10/1973 | Donnelly | F24F 3/167 454/238 |
| 4,122,761 | A | 10/1978 | Westin et al. | |
| 4,169,407 | A | 10/1979 | Dorpmund | |
| 5,191,742 | A | 3/1993 | Romig et al. | |
| 5,356,206 | A | 10/1994 | Van Valkenburgh | |
| 5,558,112 | A * | 9/1996 | Strieter | B09B 3/0066 135/900 |
| 5,575,340 | A | 11/1996 | Williams | |
| 6,036,592 | A * | 3/2000 | Rubin | G07F 17/32 131/240.1 |

(Continued)

OTHER PUBLICATIONS

Delcourt, Don, Intermodal Shipping Container Fire Safety, Fire Chiefs' Association of British Columbia Position Paper, Sep. 2014, 19 pages.

(Continued)

*Primary Examiner* — Avinash A Savani
*Assistant Examiner* — Dana K Tighe
(74) *Attorney, Agent, or Firm* — Standley Law Group LLP; Adam J. Smith; Bryan P. Finneran

(57) ABSTRACT

Systems and methods for purging smoke and other gasses from containers are provided. First portions of a coupling device are fixed to the containers and each define a first inner passageway. A second portion of the coupling device is configured for selective securement to any of the first portions to create a fluid passageway from an interior of the container, through the coupling device, to an ambient environment outside of the container. An airflow device may be fluidly connected to said second portion by ductwork.

16 Claims, 15 Drawing Sheets

(56) References Cited

U.S. PATENT DOCUMENTS

| | | | | |
|---|---|---|---|---|
| 6,402,613 | B1 * | 6/2002 | Teagle | F24F 1/0071 454/341 |
| 7,147,553 | B2 * | 12/2006 | Leask | F24F 3/163 454/65 |
| 7,913,511 | B2 | 3/2011 | Meyer et al. | |
| 8,075,653 | B2 * | 12/2011 | Phillips | B08B 15/02 55/385.2 |
| 8,146,674 | B2 | 4/2012 | Lee | |
| 9,243,734 | B2 | 1/2016 | Aubert et al. | |
| 9,505,042 | B2 | 11/2016 | Hammers et al. | |
| 9,506,571 | B1 | 11/2016 | McCormack | |
| 9,689,108 | B2 * | 6/2017 | Hamman, Jr. | D06F 58/20 |
| 10,933,263 | B2 | 3/2021 | Lee et al. | |
| 2008/0039005 | A1 * | 2/2008 | Coven | F26B 21/001 34/523 |
| 2008/0299891 | A1 * | 12/2008 | Deng | F24F 13/078 362/96 |
| 2010/0203821 | A1 * | 8/2010 | Crucs | B08B 15/00 417/313 |
| 2013/0082115 | A1 | 4/2013 | May et al. | |
| 2013/0319020 | A1 | 12/2013 | Neeld | |
| 2020/0011072 | A1 | 1/2020 | Ha | |
| 2020/0243813 | A1 | 7/2020 | Zhang et al. | |
| 2021/0372646 | A1 * | 12/2021 | Brasher | F24F 7/007 |

OTHER PUBLICATIONS

Quora, What are the different types of valves used in HVAC?, Quaora.com, 2018, 8 pages.

Tobias, Michael, Post-Fire Smoke Purge Systems in Multifamily Buildings, Nearby Engineers Blog, Sep. 8, 2018, 8 pages.

* cited by examiner

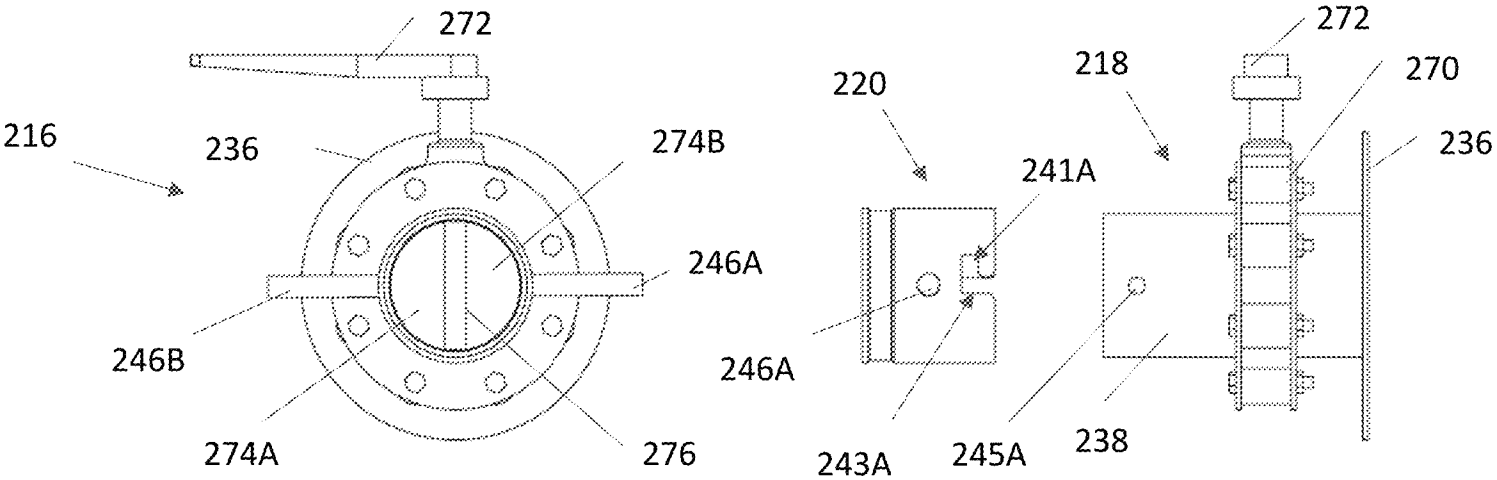
Figure 23
Figure 22
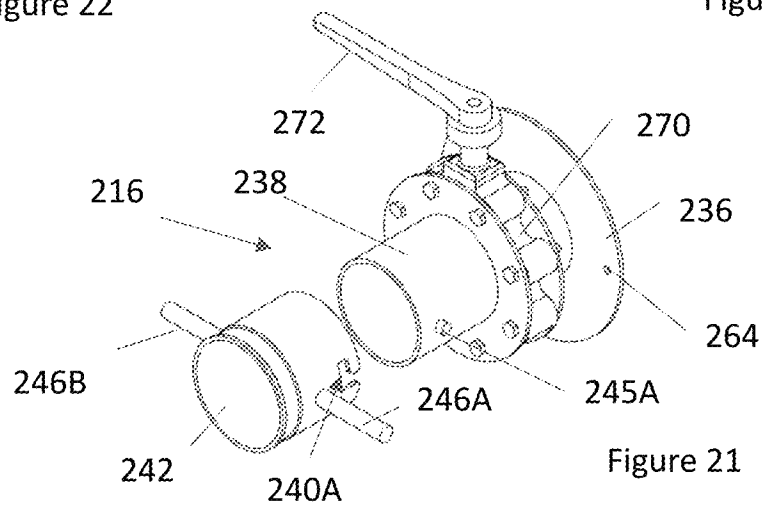
Figure 21

SYSTEMS AND METHODS FOR PURGING SMOKE OR OTHER GASSES FROM CONTAINERS

CROSS-REFERENCE TO RELATED APPLICATIONS

This application claims the benefit of U.S. Provisional Application Ser. No. 63/166,087 filed Mar. 25, 2021 and U.S. Provisional Application Ser. No. 63/255,207 filed Oct. 13, 2021, the disclosures of each of which are hereby incorporated by reference as if fully restated herein.

TECHNICAL FIELD

Exemplary embodiments relate generally to systems and methods for purging smoke or other gasses from containers, such as shipping containers, rooms, enclosures, or energy storage system(s).

BACKGROUND AND SUMMARY OF THE INVENTION

Containers are used for a variety of purposes, including but not limited to shipping and/or storing a variety of products. Some such containers are fully or partially sealed to protect contents stored within from the outside environment. For example, contents stored in the container may be water sensitive and the container may be at least partially sealed against liquid intrusion to keep such components dry.

Some contents of such containers may be flammable. For example, without limitation, the rise in popularity of battery powered products—from consumer electronics to electric vehicles, has given rise to increased shipping and storage of batteries. Such batteries may experience combustion events, such as when exposed to certain conditions. Sometimes, relatively large quantities of such batteries are shipped or stored in partially or fully sealed containers, such as but not limited to shipping containers and/or energy storage system ("ESS") containers. Should one or more such batteries have an incident, such as but not necessarily limited to ignition, pressure may build within the container which may result in an explosion or deflagration. Furthermore, firefighting or extinguishing efforts for such incidents may be rendered difficult as access to such containers may be limited to prevent accidental rupture, an in-rush of oxygenated air, combinations thereof, or the like. What is needed is a smoke and off-gas purge system for containers.

A purge system, such as for smoke and/or other off-gasses, for a container and methods regarding the same are disclosed. The disclosures provided herein may be used with any type or kind of container, including but not necessarily limited to, vessels, boxes, rooms, chambers, buildings, or other fully or partially enclosed spaces used for any purpose and/or to store any type, kind, or number of items. The container may comprise one or more potentially flammable or otherwise combustible substances stored within, such as but not limited to on racks. A first portion of a coupling device may be installed at the container. A second portion of the coupling device may be configured for selective mating with the first portion. The first portion may comprise a diaphragm which is normally closed, and which is configured for opening upon coupling with the second portion to provide fluid communication with an interior space of the container, such as for purging smoke or other gasses from the container.

A housing of the second portion may be configured to fit snugly within a housing of the first portion, though the reverse may be utilized. The housing of the first portion may comprise one or more slots configured to receive protruding elements extending outward from the housing of the second portion. The slots may be configured to pull the second portion into the first portion and/or secure the first and second portions to one another upon placement of the second portion within the first portion and rotation of the second portion relative to the first portion. In other exemplary embodiments, the housing of the second portion may comprise one or more slots configured to receive protruding elements extending outward from the housing of the first portion. Protrusions may also be provided on the housing of the second portion, though such is not required, such as to facilitate manual manipulation. The housings of the first and second portions may be hollow such that gasses purged from the container may travel therethrough. The housings may comprise complementary hollow cylinder shapes.

One or more protrusions may extend from the housing of the second portion to contact and push a flat portion of the diaphragm rearward as the coupling device is moved into the coupled state. A shaft of the diaphragm may extend through a hole in a support spanning the hollow interior of the housing of the second portion. One or more springs may be provided about the shaft between the support and one or more protruding members on the shaft such that the springs are compressed as the diaphragm is forced inward, thereby biasing the diaphragm in a closed position so that when the second portion is uncoupled, the diaphragm closes to maintain the fully or partially sealed state of the container. Alternatively, or additionally, a valve may be provided which is manually operated. For example, without limitation, the valve may be a butterfly valve installed at the first portion.

Ductwork may extend from the second portion of the coupling device. The ductwork may include flexible tubing by way of non-limiting example. One or more airflow devices may be provided at or along the ductwork. The airflow devices may comprise one or more fans. The first portion may be configured to fit one or more of a variety of size, shape, and/or type of containers.

The airflow devices may be activated to purge smoke or other gasses from the container when the second portion is coupled to the first portion, thereby opening the diaphragm. In other exemplary embodiments, the airflow devices need not be provided or activated and the smoke or other gasses may escape the container by natural forces. In exemplary embodiments, the airflow devices may be manually activated (directly or remotely), or automatically activated, such as upon coupling of the coupling device, detection of smoke or other conditions in the container, combination thereof, or the like.

In exemplary embodiments, without limitation, a number of first portions of the coupling device may be installed across a number of containers. Each of the first portions may be configured for universal connection with a second portion. In this manner, where a thermal event, such as but not necessarily limited to a fire, is determined at one of the containers, the second portion may be quickly attached for purging the smoke and other gasses from an interior of the container to the ambient environment. For example, without limitation, the second portion may be fluidly connected to an airflow device, such as by way of flexible ductwork, to provide such purging. The first and/or second portions of the coupling device may include an automatically opened fluid control device, such as biased diaphragm, or a manually or automatically controlled device, such as a valve.

Further features and advantages of the systems and methods disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein:

FIG. 21 is a perspective view of another exemplary embodiment of the coupling device in a decoupled position for the purge system of FIG. 1A;

FIG. 22 is a front view of the coupling device of FIG. 21;

FIG. 23 is a side view of the coupling device of FIG. 21;

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Figure 1A:
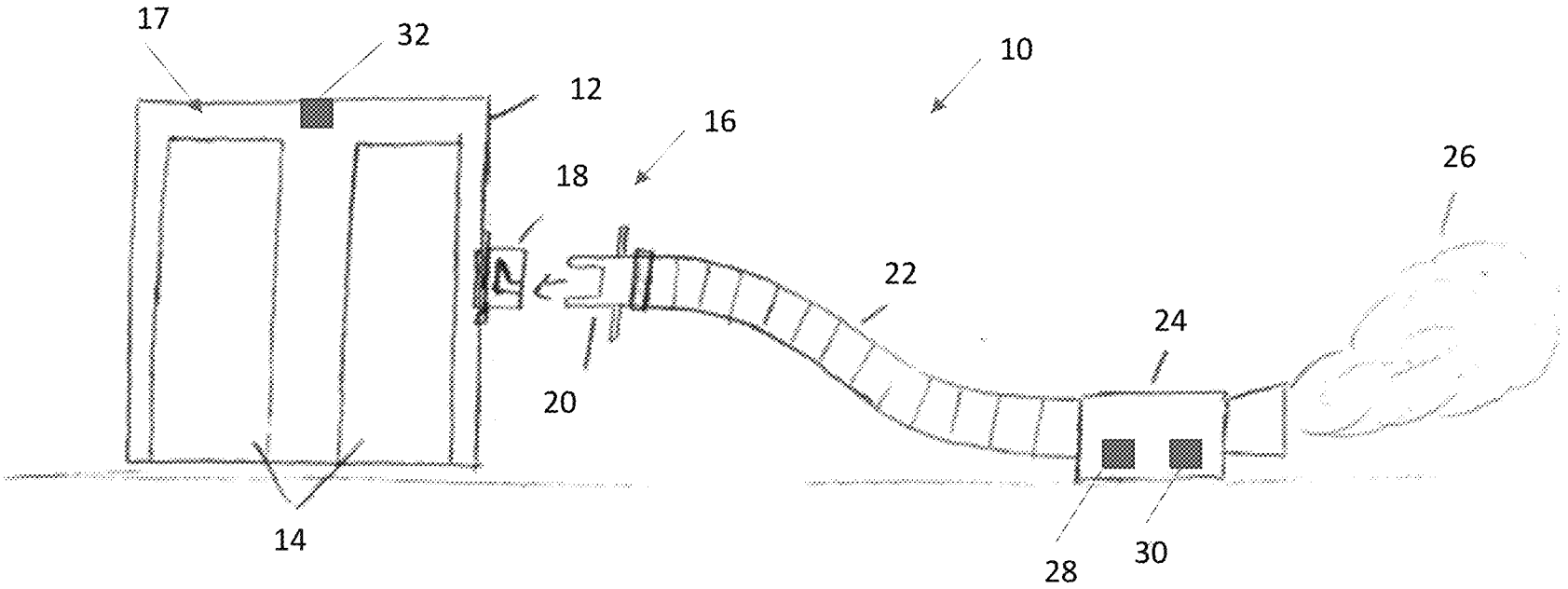
FIG. 1A is a side view of an exemplary purge system.
Figure 1B:
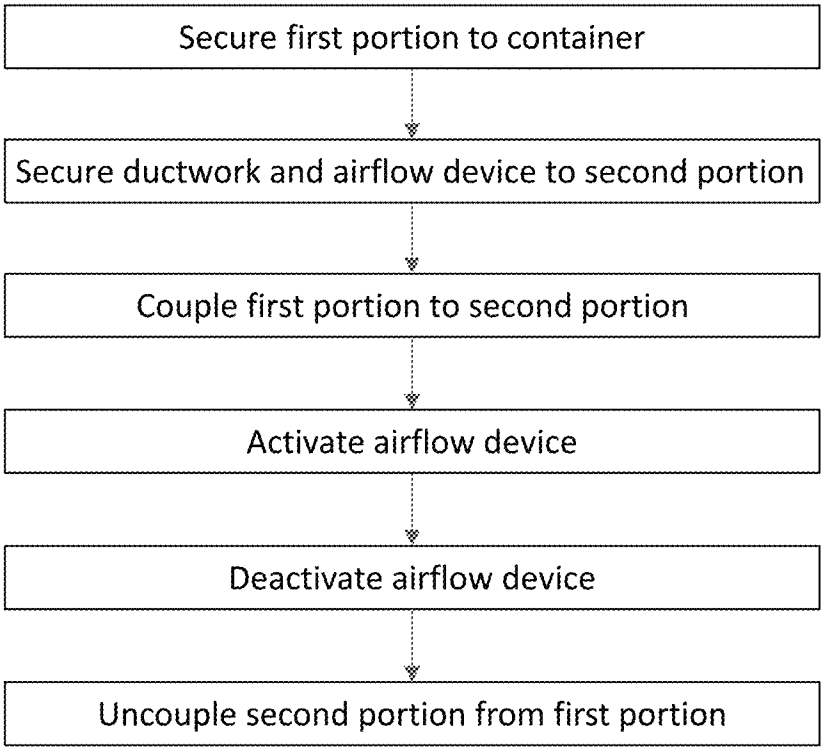
FIG. 1B is a flow chart with exemplary steps for operating the system of FIG. 1A.

FIG. 1A illustrates an exemplary purge system 10 for a container 12, such as to remove smoke or other off-gasses from a thermal event, such as but not necessarily limited to a fire or other combustion. The disclosures provided herein, including but not limited to the system 10, may be used with any type, kind, and/or number of containers 12. The container(s) 12 may include, but are not necessarily limited to, vessels, boxes, rooms, chambers, buildings, or other fully or partially enclosed spaces used for any purpose and/or to store any type, kind, or number of items. FIG. 1B illustrates exemplary steps for operating the system 10. The container 12 may be partially or fully sealed, such as but not limited to, sealed against solid particulate above a given size, liquid tight, air tight, combinations thereof, or the like. Alternatively, or additionally, the container 12 may be ingress protection (IP) rated to various standards and/or designed to meet other industry standards. For example, without limitation, the container 12 may be a shipping and/or storage container. In exemplary embodiments, without limitation, the container 12 may be an energy storage system ("ESS") container. For example, without limitation, the container 12 may be an intermodal container, such as but not limited to, one which complies with ISO 6346 or other industry standard(s). Any number or type of containers 12 of the same or different sizes, shapes, types, or the like may be utilized.

One or more substances 14 substances 14 may be located within the container 12. The substances 14 may be potentially flammable, flammable, combustible, thermally sensitive, combinations thereof, or the like. The substances 14 may be organized on one or more shelves, racks, mounting structures, combinations thereof, or the like. In exemplary embodiments, the substances 14 comprise one or more energy storage components, such as but not necessarily limited to batteries, capacitors, cells, power modules, combinations thereof, or the like, though any type or kind of substances of the same or different size, shape, type, or the like may be stored within one more of the containers 12.

A first portion 18 of a coupling device 16 may be mounted to, installed at, or integrally formed with the container 12. For example, without limitation, the first portion 18 may be welded to, bonded to, fastened to, and/or integrally formed with a wall or other surface of the container 12. Multiple such first portions 18 of the same or different size, shape, type, or the like may be installed at one or more locations of the container 12, though a single such first portion 18 may be utilized per container 12.

A second portion 20 of the coupling device 16 may be configured for selective attachment to said first portion 18. A proximal portion of one or more ducts 22 of various size, shape, type, or the like may be attached to said second portion 20. An airflow device 24 may be attached to a distal portion of said one or more ducts 22. In exemplary embodiments, a single duct 22 may extend from each one of the second portions 20 and be attached to a single airflow device 24, though multiple ducts 22 and/or airflow devices 24 may be attached to, or in fluid communication with, any one of the second portions 20. The ducts 22 may be flexible, in exemplary embodiments. For example, without limitation, the ducts 22 may comprise flexible, bendable, and/or telescopic tubing.

The airflow device 24 may comprise one or more fans. The fans may be explosion proof and/or intrinsically safe. Any type, kind, number, size, or the like of fans of the same or different type may be utilized in the airflow device 24. Such fans may, for example without limitation, utilize a brushless motor and/or partially or wholly separate the motor from the fan blades(s), which may be mechanically linked by way of one or more belts, chains, linkages, shafts, gears, combinations thereof, or the like. The airflow devices 24 may be configured to reduce the potential for, or prevent, the ignition of gasses, which may be potentially flammable, flammable, combustible, thermally sensitive, or the like, passing through at least portions of the airflow devices 24.

In exemplary embodiments, a single or multiples ones of the first portions 18 may be installed at a given container 12. Alternatively, or additionally, single or multiples ones of the first portions 18 may be installed at multiple containers 12. Each of the first portions 18, in exemplary embodiments without limitation, may be configured to mate with a single or multiple ones of the second portions 20 in a universal or semi-universal fashion. By way of non-limiting example, a single airflow device 24 may be coupled to any one of a number of containers 12, such as when a thermal event, such as but not limited to a fire or other combustion, occurs at one of the containers 12, to purge smoke and other gasses from the container(s) 12. In this way, for example without limitation, a single airflow device 24 and/or ductwork 22 and/or second portion 20 may be used to service a relatively large set of containers 12, each with one or more of the first portions 18 installed.

Figure 2:
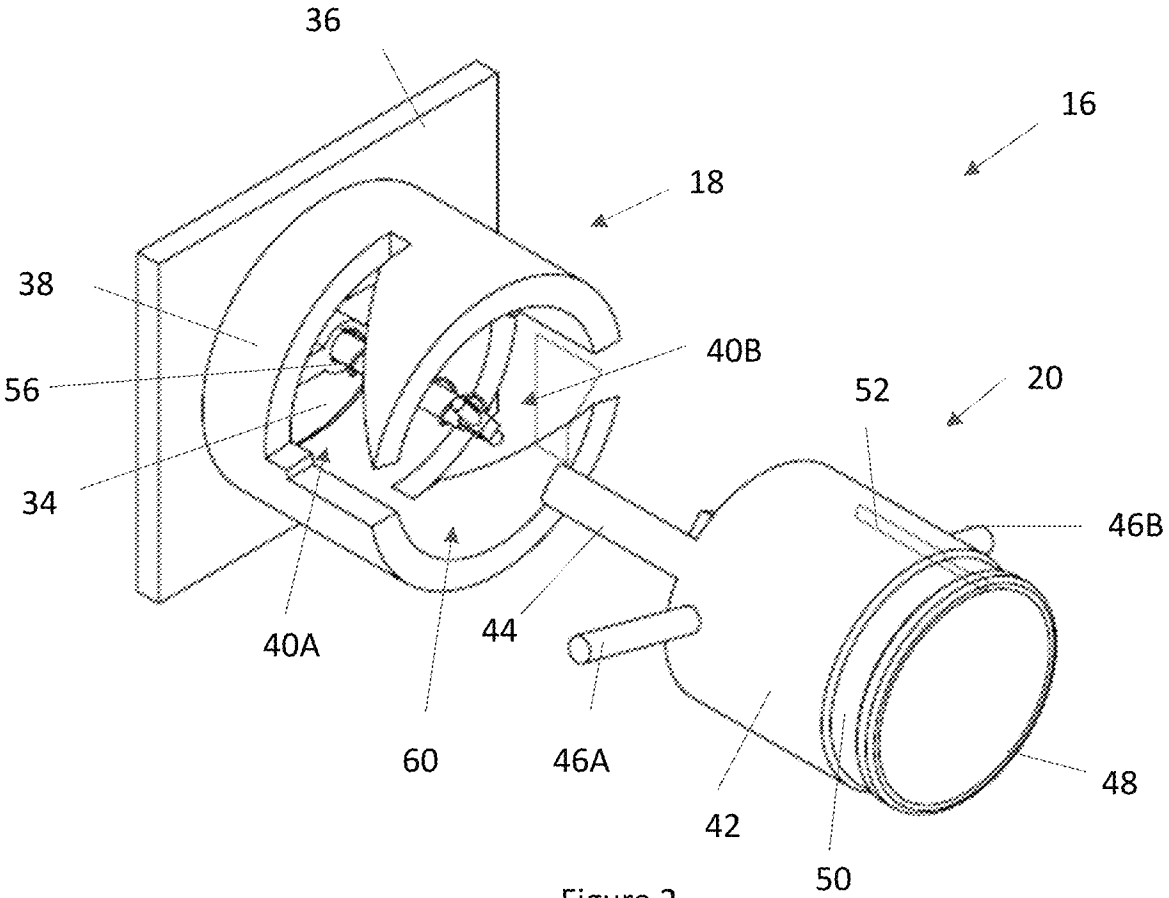
FIG. 2 is a perspective view of an exemplary coupling device in a decoupled position for the purge system of FIG. 1A.
Figure 3:
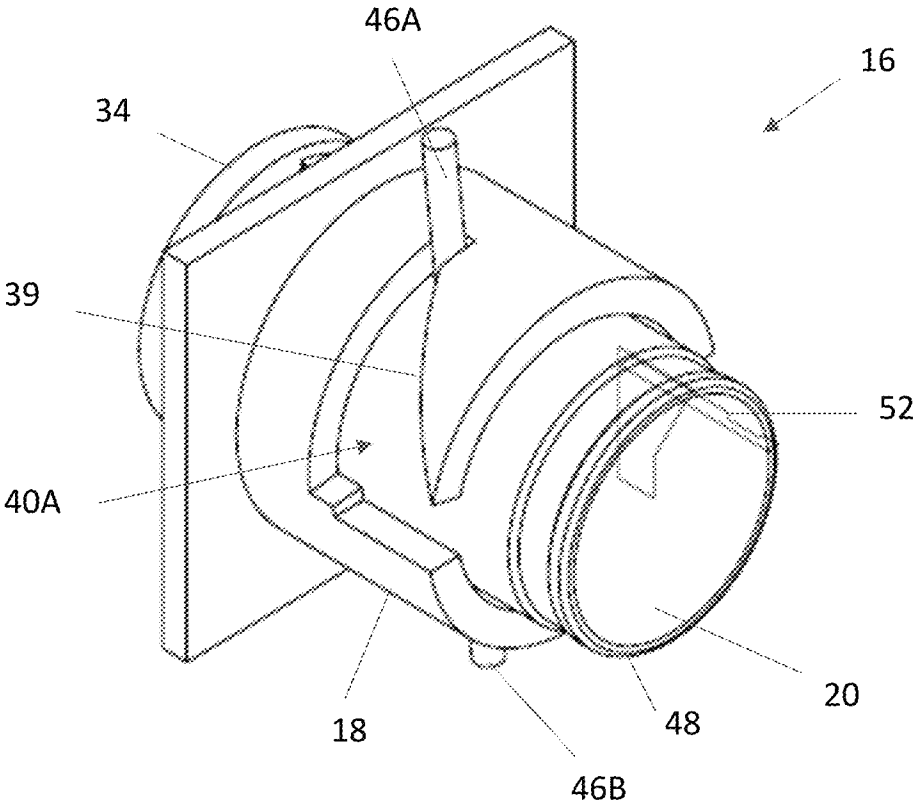
FIG. 3 is a perspective view of the coupling device of FIG. 2 in a coupled position.
Figure 5:
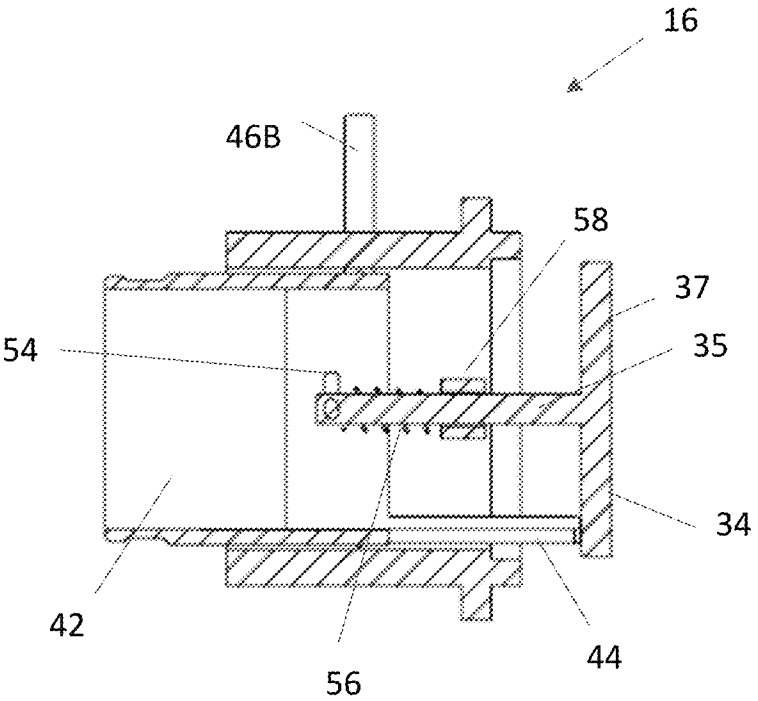
FIG. 5 is a side sectional view of the coupling device of FIG. 4 taken along section line A-A.
Figure 4:
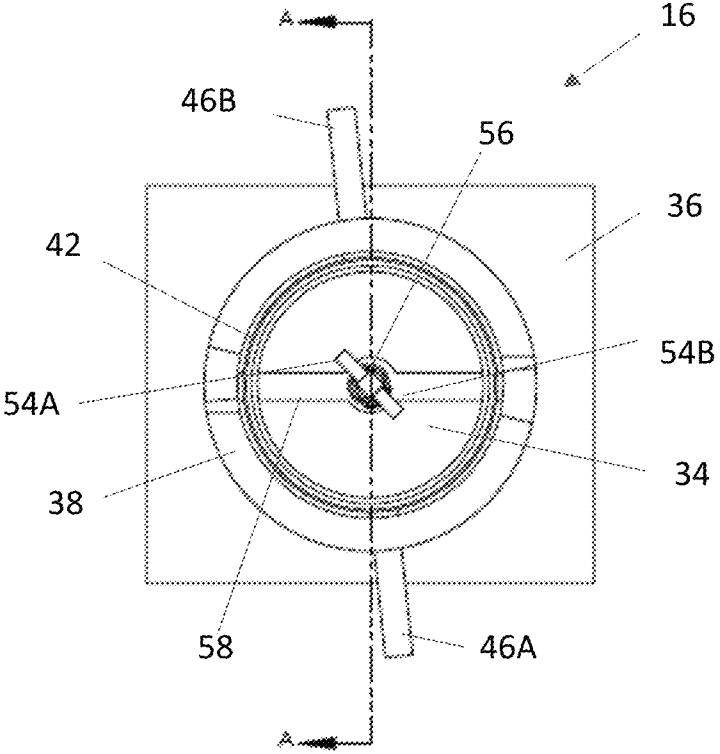
FIG. 4 is a front view of the coupling device of FIG. 3 also illustrating section line A-A.
Figure 8:
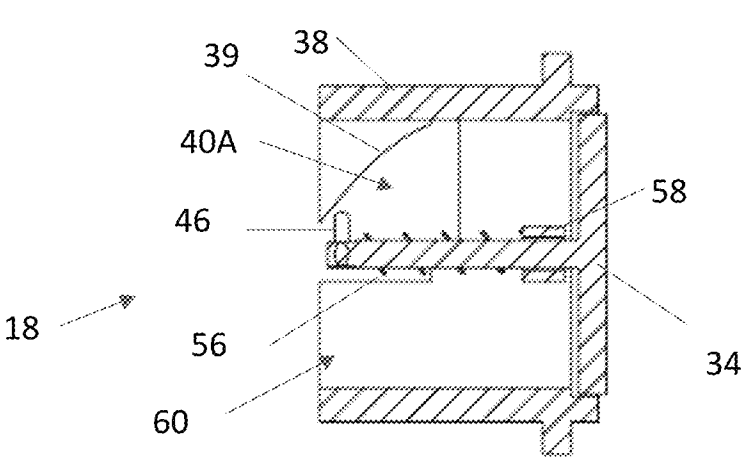
FIG. 8 is a side sectional of an exemplary first portion of the coupling device of FIG. 6 taken along section line B-B and shown in isolation.
Figure 7:
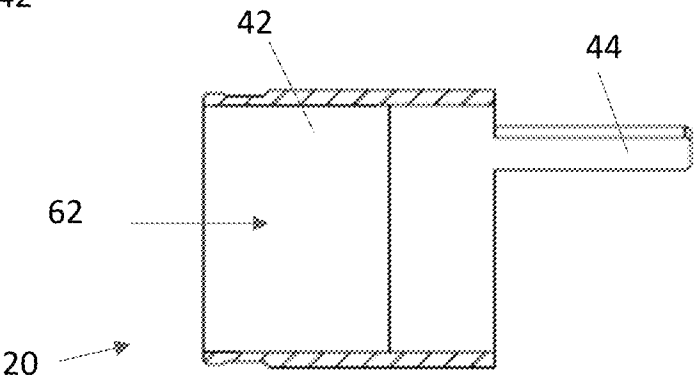
FIG. 7 is a side sectional of an exemplary second portion of the coupling device of FIG. 6 taken along section line B-B and shown in isolation.
Figure 6:
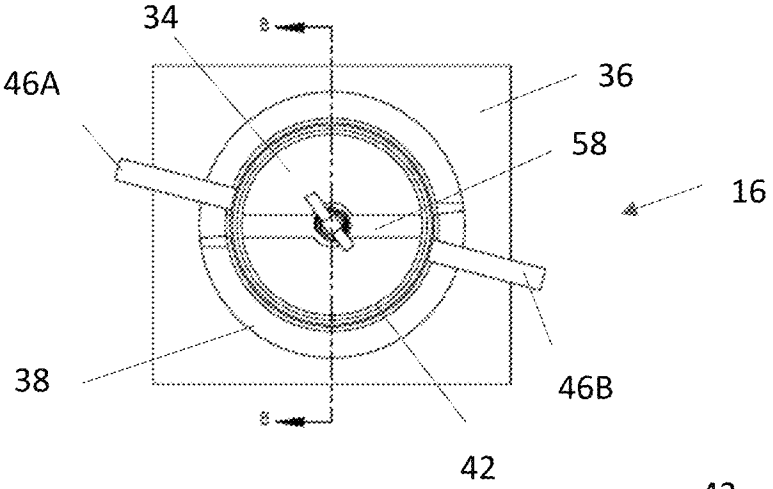
FIG. 6 is a front view of the coupling device of FIG. 2 in the decoupled position also illustrating section line B-B.
Figure 10:
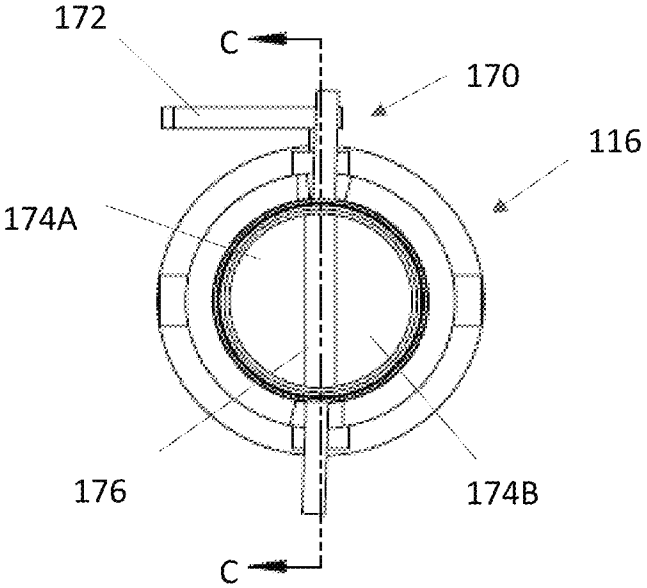
FIG. 10 is a front view of the coupling device of FIG. 9 also illustrating section line C-C.
Figure 11:
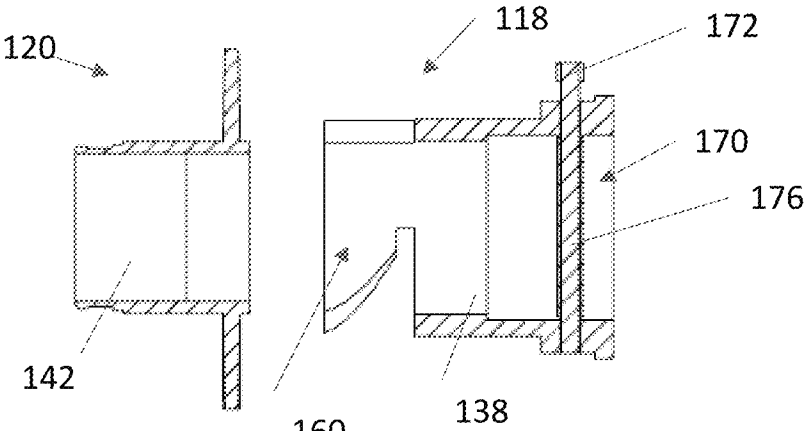
FIG. 11 is a side sectional view of the coupling device of FIG. 10 taken along section line C-C.
Figure 9:
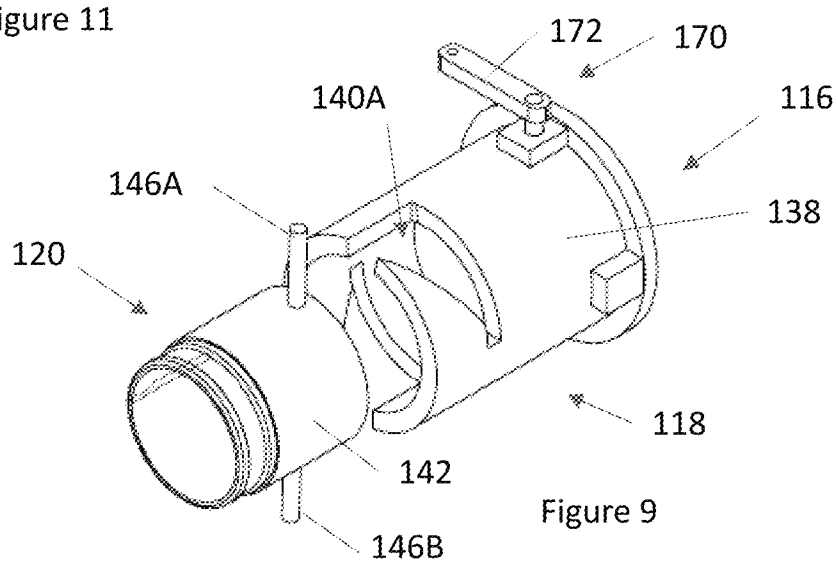
FIG. 9 is a perspective view of another exemplary embodiment of the coupling device in a decoupled position for the purge system of FIG. 1A.

FIG. 2 illustrates the coupling device 16 in a decoupled arrangement where the first portion 18 is separated from the second portion 20. FIG. 3 illustrates the coupling device 16 in a coupled arrangement where the first portion 18 is mated with the second portion 20. FIG. 4 through FIG. 8 illustrate various views of the coupling device 16, or components thereof, in isolation.

The second portion 20 of the coupling device 16 may be selectively attached to the first portion 18 of the coupling device 16, such as at the container 12, to create a fluid passageway from an interior space 17 of said container 12 to an ambient environment outside the container 12. The airflow device(s) 24 may be activated to purge gasses, such as but not necessarily limited to smoke, off-gasses, enclosed air, particulate, and/or other substances within the interior 17 of the container 12 to the ambient environment. In exemplary embodiments, the system 10 may be used to selectively purge smoke and/or other gasses 26 from the container 12 in a controlled manner, such as where one or more of the substances 14 located within the container 12 catches fire, appears susceptible to catching fire, to create at least a partial vacuum, as a precaution, or for other reasons.

The duct(s) 22 may be permanently or removably connected to the airflow devices 24 and/or the second portion 20. In other exemplary embodiments, the airflow device(s) 24 may be directly connected to the second portion 20 of the coupling device 18 such that the duct(s) 22 are not required.

The airflow devices 24 may be manually or automatically activated. For example, without limitation, the airflow devices 24 may comprise one or more controllers 28 configured to control activation, speed, run time, combinations thereof, or the like of the airflow devices 24. The controller 28 may comprise a control panel on an exterior of a housing for the airflow devices 24, for example without limitation, that may be manually activated, such as but not limited to by actuation of one or more buttons, levers, knobs, computer icons, combinations thereof, or the like. Alternatively, or additionally, the controller 28 may be configured to receive signals for activating or otherwise controlling operation of the airflow devices 24 from one or more remotely located electronic devices. In such embodiments, one or more network communication devices 30 may be provided which facilitate such wired or wireless communication. The remotely located electronic devices may include smartphones, tablets, computers, servers, control panels, buttons, combinations thereof, or the like.

For example, without limitation, the second portion 20 may be attached to the first portion 18 upon determination that an incident, such as but not necessarily limited to a fire, is present, or may be present, within one of the containers 12, and the airflow device 24 may be manually activated locally or remotely. As another example, without limitation, the second portion 20 may be attached to the first portion 18 while the container 12 is at a particular site, or otherwise as a precaution, and the airflow device 24 may be manually activated locally or remotely upon determination that an incident, such as but not necessarily limited to a fire is, or may be, present or for other reason.

In other exemplary embodiments, the airflow device 24 may be automatically activated and/or deactivated, driven at certain setting (e.g., fan speed, fan run time, etc.), combinations thereof, or the like, such as but not limited to, in response to data received from one or more sensors 32 at the controller 28 or other devices. Such sensors 32 may comprise smoke detectors, temperature sensors, pressure sensors, airflow sensors, voltage sensors, current sensors, light sensors, air samplers, microphones, combinations thereof, or the like. For example, without limitation, the second portion 20 may be attached to the first portion 18 upon arrival of the container 12 at a site, or sometime thereafter, and the airflow device 24 may be automatically activated upon receipt of data from the sensor(s) 32 indicating that an incident, such as but not necessarily limited to a fire is present, possibly present, is susceptible to occurring, combinations thereof, or the like.

Alternatively, or additionally, the airflow device 24 may be automatically activated upon coupling of the coupling device 16. For example, without limitation, one or more of the sensors 32 may be located at the first portion 18 or the second portion 20 and may be configured to detect mating of the coupling device 16. In such embodiments, the sensors 32 may comprise one or more pressure sensors, switches, accelerometers, proximity, limit switch, light sensor, combinations thereof, or the like. Such sensors 32 may be in wired or wireless communication with the controller 28 which may be in wired or wireless communication with the airflow device 24 and configured to activate the airflow device 24 upon receipt of data from the sensors 32 indicating mating of the first portion 18 with the second portion 20.

In other exemplary embodiments, smoke and other gasses within the container 12 may be vented through the coupling device 16 by natural pressure and the airflow device 24 and/or ducts 22 may not be required.

Upon placement of the coupling device 16 in the coupled position (e.g., mating of the first and second portions 18, 20), a diaphragm 34 of the first portion 18 may be opened to permit fluid communication between the interior 17 of the container 12 and the ambient environment, such as but not limited to, by way of the duct(s) 22 and/or airflow device(s) 24. Upon placement of the coupling device 16 in the decoupled position (e.g., disengagement of the second portion 20 from the first portion 18), the diaphragm 34 of the first portion 18 may be closed so as to fully or partially seal the container 12 or otherwise return the container 12 to its normal state. The diaphragm 34 may be biased in the closed position in exemplary embodiments. In other exemplary embodiments, however, the diaphragm 34 may be biased in the opened position.

The first component 18 may comprise a housing 38. The housing 38 may define a hollow interior space 60. In exemplary embodiments, the housing 38 may be shaped as a hollow cylinder, though any shape and/or size housings 38 may be utilized. The housing 38 may be mounted to, connected to, or integrally formed with a container adapter 36. In exemplary embodiments, the container adapter 36 may comprise a plate configured to be mounted to, mate with, form part of, replace part of, combinations thereof, or the like, a relatively flat surface of the container 12, though such is not required. The container adapter 36 may be mounted to, connected to, or integrally formed with the container 12. In other exemplary embodiments, the housing 38 may be mounted to, connected to, or integrally formed with the container 12 such that the container adapter 36 is not required. An appropriate size hole may be formed in (e.g., by cutting, punching, integral formation, or the like) the container 12 to accommodate the container adapter 36 and/or the housing 38.

One or more slots 40A, 40B may be formed in the housing 38. The slots 40 may extend from a distal edge of the housing 38 inward, and may comprise a portion which extends about a portion of a perimeter (which in exemplary embodiments may be a circumference) of the housing 38.

The housing 38 of the first portion 18 may be sized to accommodate some or all of a housing 42 of the second portion 20. In exemplary embodiments, the housing 38 of the first portion 18 and the housing 42 of the second portion 20 may comprise complementary shapes such that said housing 42 of the second portion 20 fits snugly within the housing 38 of the first portion 18, such as in a fully or partially sealed arrangement. The fit may be sufficiently snug to prevent leakage of smoke particulate and/or prevent or limit accidental removal, by way of non-limiting example.

The slots 40A, 40B in the first portion 18 may be configured to accommodate corresponding protruding elements 46A, 46B of the second portion 20. The protruding elements 46 may each extend outward from an outer surface of the housing 42 of said second portion 20. The protruding elements 46 may be shaped as cylindrical rods, though any shape may be utilized. The protruding elements 46 may be bonded to, connected to, or integrally formed with the housing 42. In exemplary embodiments, an equal number and spacing of slots 40 may be provided at the first portion 18 for each of the protruding elements 46 of the second portion 20, however any number, type, size, shape, and/or arrangement of protruding elements 46 may be utilized. The protrusions 46 may provide grip points for physical manipulation of the second portion 20, such as for insertion/removal and/or rotation within the slots 40. The protrusions 46 may comprise shafts and/or may comprise elements configured to assist with physical manipulation and/or handling such as but not limited to, textured surfaces, high coefficient of friction materials, handles, combinations thereof or the like. Alternatively, or additionally, components configured to assist with physical manipulation and/or handling of the second component 18, such as but not limited to, textured surfaces, high coefficient of friction materials, handles, combinations thereof or the like, may be provided elsewhere at the second component 18 in addition to the protrusions 46.

Each of the slots 40 may be configured to receive one of the protruding elements 46 as the second portion 20 is advanced within the interior space 60 of the first component 18. The slots 40 may permit rotational movement of the second portion 20 relative to the first portion 18 to temporarily secure the second portion 20 to the first portion 18 in the coupled arrangement. The slots 40 may each comprise a curved edge 39 configured to force said second portion 20 further into said first portion 18 as the protruding elements 46 are placed within the slots 40 and the second portion 20 is rotated relative to said first portion 18. The second portion 20 may be selectively rotated in an opposing direction to permit removal of the protruding elements 46 of the second portion 20 from the slots 46 of the first portion 18 to place the coupling device 16 in the uncoupled state. The housings 38, 42 of the first and/or second portions 18, 20 may comprise a taper, threads, combinations thereof, or the like, configured to secure the first portion 18 to the second portion 20 as the two are rotated and/or otherwise moved into the coupled positioned.

A support 58 may extend across the interior space 60. The support 58 may extend between opposing interior surfaces of the housing 38, for example. In exemplary embodiments, the support 38 may extend substantially about a diameter of a proximal portion of the interior space 60. The support 38 may be configured to accommodate a portion of a diaphragm 34. In exemplary embodiments, the support 38 may comprise a central aperture configured to accommodate a shaft 35 extending from a sealing portion 37 of said diaphragm 34. The shaft 35 may comprise a cylindrical shaped rod. The sealing portion 37 may comprise a flat plate or plates. The sealing portion 37 may be sized to snugly fit within some or all of the interior space 60 so as to provide a full or partial seal when so positioned. One or more gaskets may be provided about the sealing portion 37 and/or the corresponding portion of the housing 38 to provide such sealing. The fit may be sufficiently snug to prevent leakage of smoke, gasses, and/or particulate and/or meet various ingress protection or other industry standards, by way of non-limiting example.

The support 38 may be located at a proximal end of the housing 38, such as but not limited to co-planar with, or interior to, the plate 68 and/or adjacent portion of the container 12 such that the diaphragm 34 is located interior to or substantially co-planar with the plate 68 and/or adjacent portion of the container 12 when the first portion 18 is mounted to the container 12 and the diaphragm 34 is in a closed position, though such is not required. For example, without limitation, the support 58 may be located at another portion of the housing 38 such that the diaphragm 34 is located forward of the container adapter 36 and/or the adjacent portion of the container 12 when the diaphragm 34 is in the closed position.

One or more protruding members 54A, 54B may be provided at a distal portion of the shaft 35. One or more springs 56 may extend along the shaft 35 between the protruding members 54 and the support 58. In exemplary embodiments, the spring 56 may comprise a compression spring which encircles some or all of the shaft 35. A first portion of the spring 56 may frictionally engage, or be attached to, one or more of the protruding members 54. A second portion of the spring 56 may frictionally engage, or be attached to, the support 38. The spring 56 may be configured to bias the diaphragm 34 in the closed position, such as where the diaphragm 34 is located adjacent to support 38. When in the closed position, the sealing portion 37 may be located partially or wholly within the interior space 60 of the first portion 18 of the coupling device 16, or be otherwise positioned to fully or partially seal the coupling device 16, preferably in a gas or liquid tight manner. In this way, the container 12 may remain fully or partially sealed, or otherwise in its normal state when the diaphragm 34 is in the closed position. The seal may be sufficient to prevent leakage of smoke, gasses, and/or particulate and/or meet various ingress protection or other industry standards, by way of non-limiting example.

The second portion 20 may comprise one or more protrusions 44. The protrusions 44 may extend parallel with a longitudinal and/or centerline axis of an interior space 62 of the housing 42, though such is not required. In exemplary embodiments, the protrusions 44 may extend beyond an end or other remaining portion of the housing 42. A portion of the protrusion 44, such as a tip, may be configured to contact a portion of the diaphragm 34, such as a front surface of the sealing portion 37, when the second portion 20 is advanced within the interior space 60 of the first portion 18 (e.g., as the coupling device 16 is moved into the coupled arrangement). The protrusion 44 may fictionally engage the diaphragm 34, causing the diaphragm 34 to move interior relative to the container adapter 36, housing 38, and/or adjacent portion of the container 12, thereby placing the diaphragm 34 in an opened position such that said sealing portion 37 is moved out of the interior space 60 or otherwise moved such that smoke, gases, and/or particulate within the container 12 may escape through the coupling device 16 to the ambient environment, for example. In exemplary embodiments, the protrusion 44 may be configured to contact the flat portion 37 of the diaphragm 34. In other exemplary embodiments, the protrusions 44 or other portion of the second portion 20 may be configured to contact and push the shaft 35 or other portion of the diaphragm 34.

The spring 56 may be placed in compression as the diaphragm 34 is moved into the opened position, such as due to compression caused by sliding movement of the shaft 35 through the hole in the support 58 and the corresponding advancement of the protruding members 54 relative to the support 58. In this way, the diaphragm 34 may be automatically placed into the closed position upon decoupling of the coupling device 16, thereby biasing the diaphragm 34 in the closed position. In other exemplary embodiments, the diaphragm 34 may be biased in the opened position.

The second portion 20 may comprise one or more threads 48 on a distal end thereof. The threads 48 may be configured to mate with corresponding threads on the duct(s) 22. Alternatively, or additionally, the second portion 20 may comprise one or more stepped or recessed portions 50 configured to accommodate the duct(s) 22. The threads 48 and/or the stepped or recessed portions 50 may be configured to provide a full or partial sealed connection between the second portion 20 and the duct(s) 22. One or more gaskets may be provided between the duct(s) 22 and the second portion 20 to facilitate such a sealed connection. The fit may be sufficiently sealed to prevent leakage of smoke, gasses, and/or particulate and/or meet various ingress protection or other industry standards, by way of non-limiting example.

The second portion 20 may comprise one or more alignment devices 52. The alignment devices 52 may comprise one or more members extending along an interior surface of the housing 42 and may be configured to align the second portion 20 with the duct(s) 22 upon connection.

While the second portion 20 of the coupling device 16 is discussed as fitting within the first portion 18, the reverse may be utilized. For example, without limitation, the housing 38 of the first portion 18 may be configured to fit snugly within the housing 42 of the second portion 20. Alternatively, or additionally, various components of each portion 18, 20 may be provided on the opposing portion. For example, without limitation, the slots 40 may instead be provided on the second portion 20 and the protruding elements 46 on the first portion. Other mechanisms for selectively securing the two portions 18, 20 to one another may be utilized alternatively, or in addition to, such as but not limited to, clamps, buckles, fasteners, threads, combinations thereof, or the like.

The coupling device 16, and various components thereof, may comprise one or more metals, polymers, combinations thereof, or the like.

FIG. 9 through FIG. 20 illustrate other exemplary embodiments of the coupling device 116. Similar items may be numbered similarly but increased by 100 (e.g., 16 to 116, 18 to 118, 20 to 120, etc.). The coupling device 116 may be used with the purge system 10 and/or some or all components of the same. The coupling device 116 may comprise some or all of the features, components, or the like of the coupling device 16, even if not otherwise stated, though such is not necessarily required. The coupling device 116 may comprise a valve 170. The valve 170 may be manually or automatically operated. The valve 170 may be manually or automatically placed in an open position sometime upon or after coupling the second portion 120 to the first portion 118, and/or before or upon activation of the airflow device 24, in exemplary embodiments, though the value 170 may be opened or closed at any time. The valve 170 may be a butterfly type valve, for example without limitation. Any number and/or type of valves 170 of the same or different type may be utilized across one or more coupling devices 116.

In exemplary embodiments, the valve 170 may be provided at the first portion 118 of the coupling device 116. The valve 170 may be integrally formed with the first portion 118 or may be bonded, mounted, adhered, or otherwise attached thereto. In other exemplary embodiments, the valve 170 may be provided at the second portion 120.

The valve 170 may comprise a shaft 176. The shaft 176 may extend through a hollow interior space 160 of the first portion 118. For example, without limitation, the shaft 176 may extend along a diameter of a distal portion of the hollow interior space 160, though such is not required. The shaft 176 may be configured for rotating movement. The shaft 176 may extend through a housing 138 for the first portion 118 of the coupling device 116 at one or more locations. This may secure the shaft 176 relative to the housing 138 and/or permit rotation of the shaft 176.

One or more discs 174 may extend from the shaft 176. In exemplary embodiments, a first disc portion 174A may extend from a first portion of a sidewall of the shaft 176 and a second disc portion 174B may extend from a second portion of the sidewall of the shaft 176. The first and second portions of the sidewall of the shaft 176 may be located on opposing sides of the shaft 176 such that the first disc portion 174A and second disc portion 174B extend in opposing directions. The disc portions 174A-B may be configured to match an interior size and shape defined by the housing 183 of the first portion 118, though such is not necessarily required. In this manner, the disc portions 174 may be configured to selectively obstruct passage through the first portion 118, such as by selectively providing a full or partial seal. The fit may be sufficient to prevent leakage of smoke, gasses, and/or particulate and/or meet various ingress protection or other industry standards, by way of non-limiting example. The disc portions 174A-B may each be substantially semi-circular in shape, for example without limitation.

The valve 170 may comprise a handle 172, which may be configured for manual actuation to move the valve 170 between a closed position and an opened position, and any number of positions therebetween (e.g., partially opened, partially closed). In exemplary embodiments, the valve 170 may be moved through the opened, closed, and partially opened/closed positions by rotation of the shaft 176, such as but not limited to, by way of the handle 172. For example, without limitation, rotation of the shaft 176 into the closed position, such as shown with respect to FIGS. 9-11, by way of non-limiting example, may be configured to orient the disc portions 174A-B to block or obstruct the hollow interior space 160 of the first portion 160 to block or obstruct airflow therethrough. In the closed position, the disc portions 174A-B may extend perpendicular, or substantially perpendicular, to the airflow through the coupling device 116. When in the closed position, the valve 170 need not necessarily provide a complete, 100% gas impermeable seal. The seal may be sufficient to prevent leakage of smoke, gasses, and/or particulate and/or meet various ingress protection or other industry standards, by way of non-limiting example.

Figure 13:
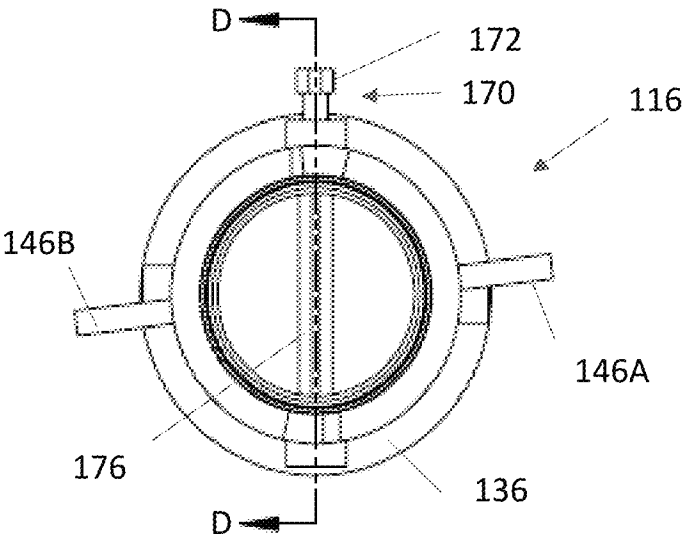
FIG. 13 is a front view of the coupling device of FIG. 12 also illustrating section line D-D.
Figure 14:
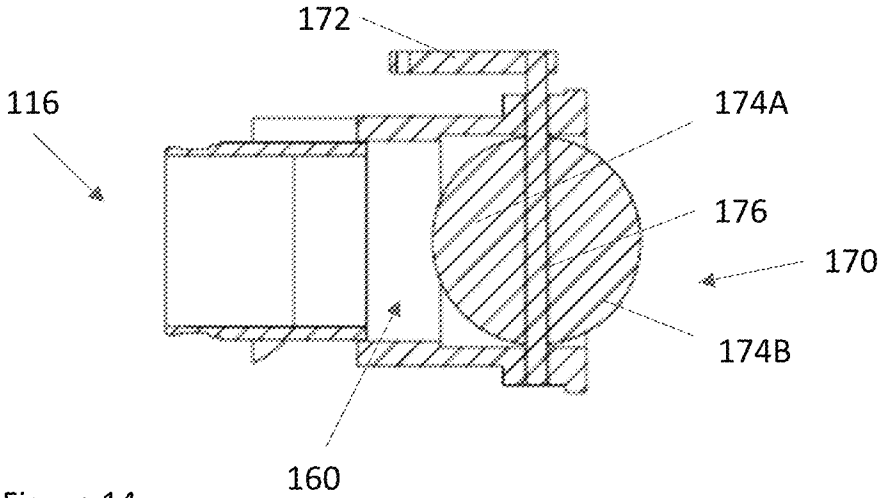
FIG. 14 is a side sectional view of the coupling device of FIG. 13 taken along section line D-D.
Figure 12:
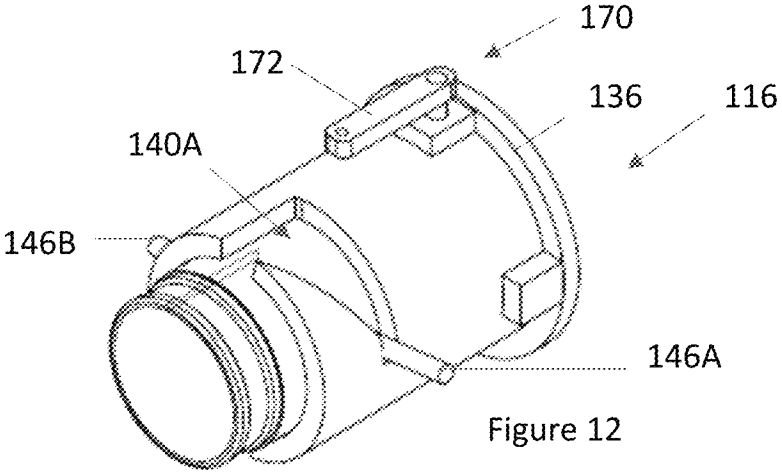
FIG. 12 is a perspective view of the exemplary coupling device of FIG. 9 in a coupled position.

As a further example, without limitation, rotation of the shaft 176 into the opened position, such as shown with respect to FIGS. 12-14 by way of non-limiting example, may be configured to orient the disc portions 174A-B so that they extend along, or substantially along, a longitudinal axis of the coupling device 116 to provide airflow passage through the hollow interior space 160. In the opened position, the disc portions 174A-B may extend parallel, or substantially parallel, to the airflow through the coupling device 116. In this manner, airflow may be provided between the interior space 17 of the container 12 and the ducts 22, and ultimately the ambient environment when the valve 170 is in the opened and/or partially opened/closed positions for example without imitation.

Movement of the shaft 176 may be accomplished by way of a handle 172 in exemplary embodiments. The handle 172 may be configured for manual actuation. In other exemplary embodiments, the shaft 176 and/or handle 172 may be actuated by a motor and/or one or more connecting components (e.g., gears, chains, levers, linkage arms, etc.) or the like. Movement of the valve 170 between the opened, closed, and/or partially opened/closed positions may be manually or electronically controlled.

The coupling device 116 may be configured to permit movement of the first and second portions 118 and 120 between the coupled position (e.g., FIGS. 12-14) and uncoupled position (e.g., FIGS. 9-11), such as in a manner independent of movement of the valve 170 between the opened position (e.g., FIGS. 12-14), closed position (e.g., FIGS. 9-11), and/or partially opened or partially closed positions such that the valve 170 may be moved between the opened position, closed position, or partially opened/closed positions while the coupling device 116 is in the coupled or uncoupled positions in exemplary embodiments, without limitation.

Figure 17:
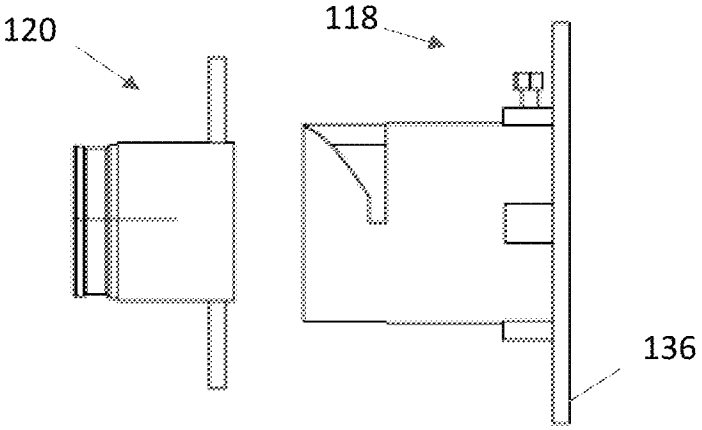
FIG. 17 is a side view of the coupling device of FIG. 15.
Figure 15:
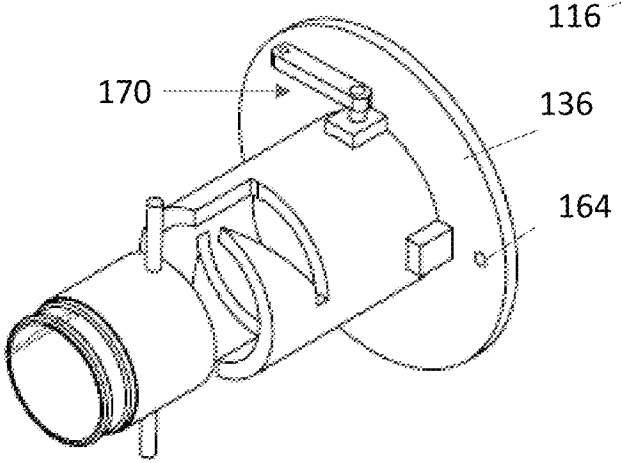
FIG. 15 is a perspective view of the coupling device of FIG. 9 including an exemplary port.
Figure 16:
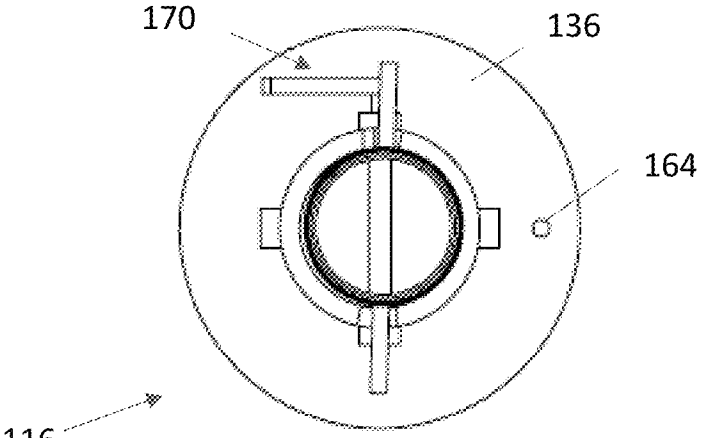
FIG. 16 is a front view of the coupling device of FIG. 15.

As illustrated with particular regard to FIGS. 15-17, the container adapter 136 or other base member may comprise one or more ports 164. Each of the ports 164 may comprise an aperture, valve (e.g., one-way valve), diaphragm, combinations thereof, or the like configured to accommodate one or more sensors, such as but not limited to a gas probe. The port(s) 164 may be configured to partially or substantially seal about the sensors when inserted and may be configured to permit the sensors sufficient access to air within the interior space 17 of the container 12 and/or the coupling device 116 to sample the air therein without allowing any, or substantial amount of, the air within the interior space 17 of the container 12 and/or the coupling device 116 to escape the container 12 and/or the coupling device 116. In exemplary embodiments, the port(s) 164 may be configured to maintain at least a 90% seal against air particles at up to at least 10 atmospheres, by way of non-limiting example. In other exemplary embodiments, the port(s) 164 may be sufficiently small holes that large amounts of smoke and other gasses are unable to escape the container 12.

For example, without limitation, a gas probe may be mated with, or otherwise inserted into, the port 164 to check for the presence or non-presence of certain gasses (such as but not limited to smoke, products of combustion, combustible materials, combinations thereof, or the like) in the air within the container 12. Alternatively, or additionally, the port(s) 164 may be used to check for temperatures, air pressures, light, combinations thereof, or other conditions indicative of an incident, such as but not necessarily limited to a fire, or potential for an incident, such as but not necessarily limited to a fire, occurring within the container 12. The port(s) 164 may be configured to accommodate a variety of types or kinds of sensors (such as but not limited to sensors 32), such as but not limited to, gas sensors, temperature sensors, air samplers, air sample collectors, pressure sensors, light sensors, microphones, smoke detectors, combinations thereof, or the like. Any number, arrangement, and type of ports 164 may be provided at any location of the coupling device 116. For example, without limitation, one or more ports 164 may alternatively or additionally be provided in the housing 138 of the first portion 118, the housing 142 of the second portion 120, combinations thereof, or the like. The ports 164 may alternatively, or additionally, allow visual, audiological, and/or olfactory based inspection and observation by a human inspection.

Figure 20:
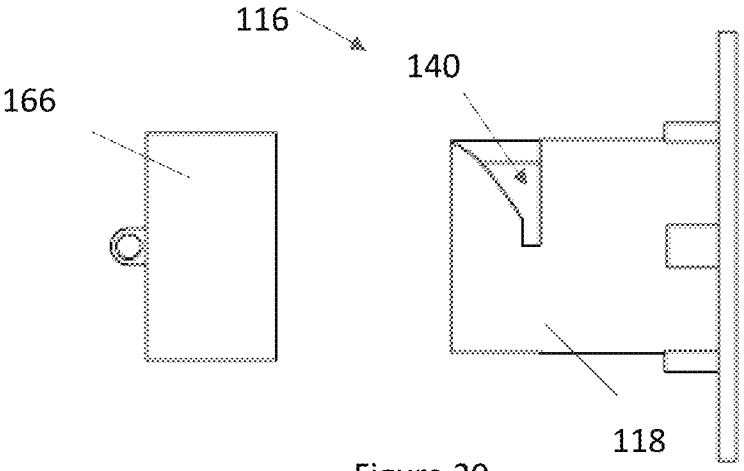
FIG. 20 is a side view of the coupling device of FIG. 18.
Figure 18:
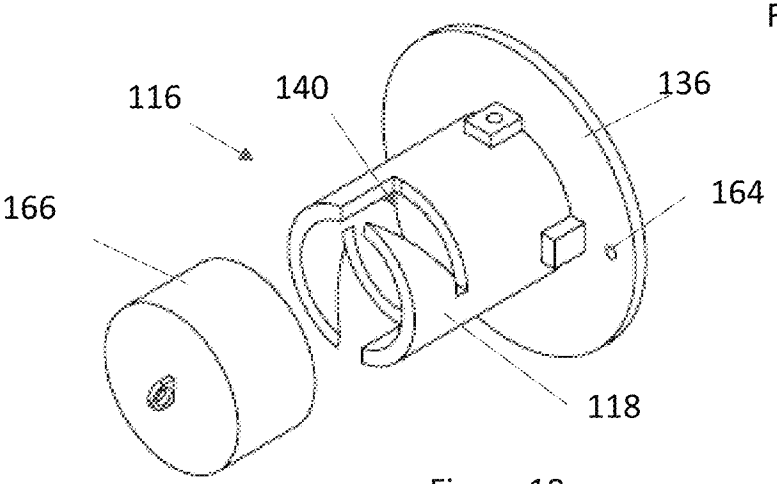
FIG. 18 is a perspective view of the first portion of the coupling device of FIG. 15 shown in isolation and including an exemplary cap in an uninstalled position.
Figure 19:
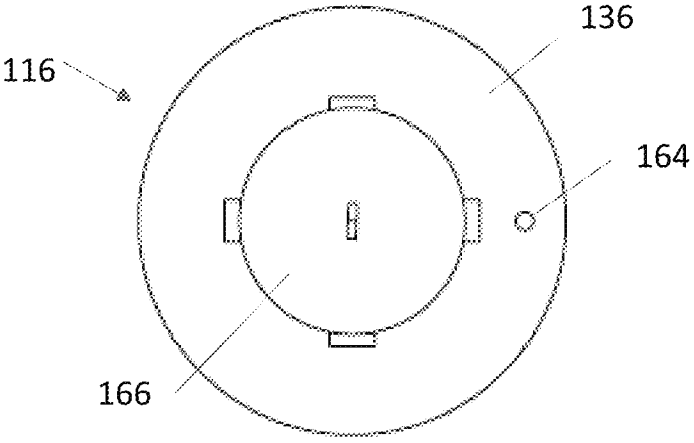
FIG. 19 is a front view of the coupling device of FIG. 18.
Figure 26:
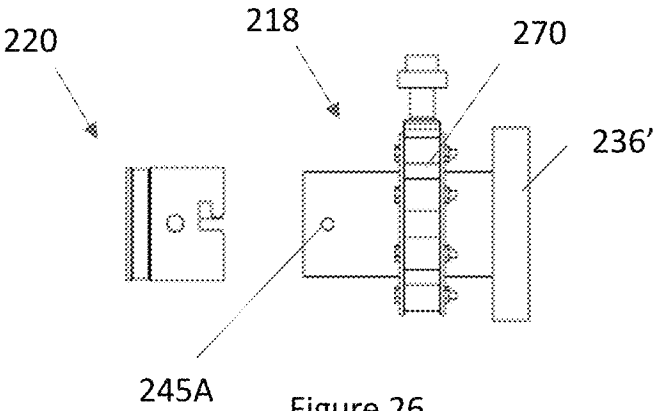
FIG. 26 is a side view of the coupling device of FIG. 24.
Figure 24:
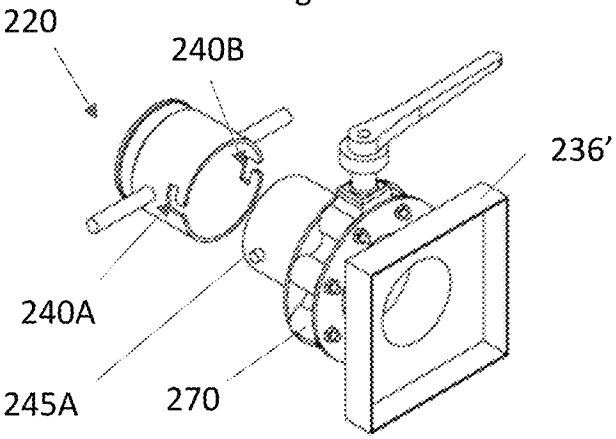
FIG. 24 is a rear perspective view of another exemplary embodiment of the coupling device in a decoupled position for the purge system of FIG. 1A.
Figure 27:
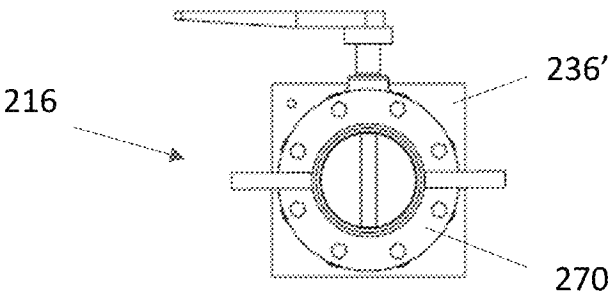
FIG. 27 is a front view of the coupling device of FIG. 24.
Figure 25:
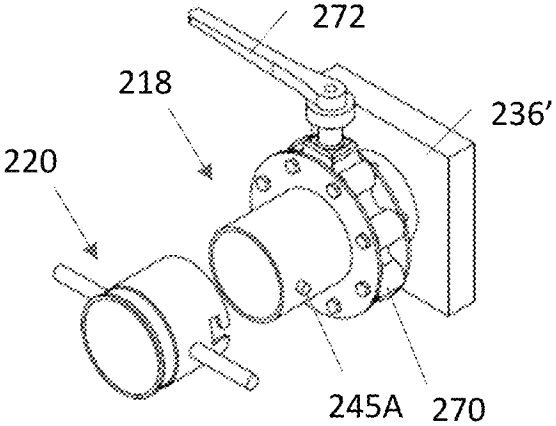
FIG. 25 is a front perspective view of the coupling device of FIG. 24.
Figure 30:
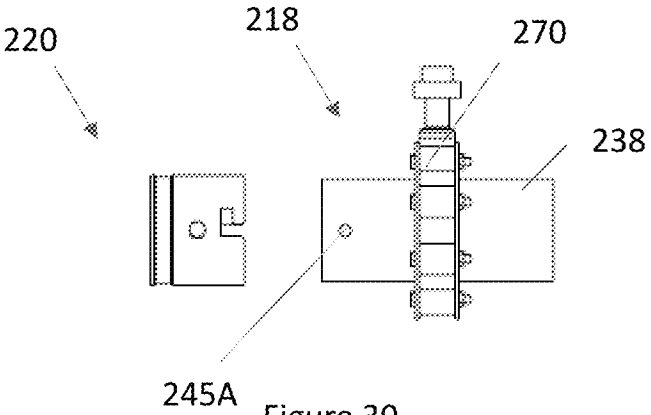
FIG. 30 is a side view of the coupling device of FIG. 28.
Figure 28:
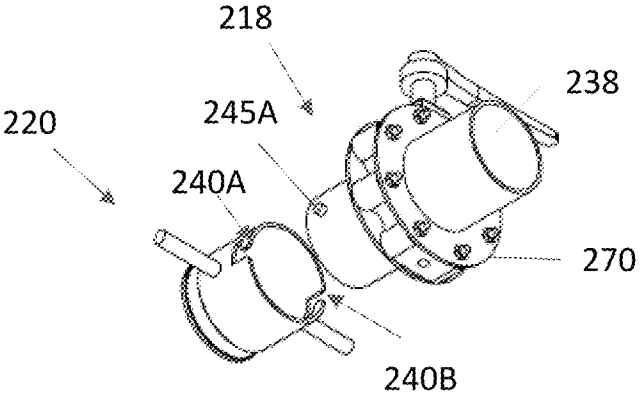
FIG. 28 is a rear perspective view of another exemplary embodiment of the coupling device in a decoupled position for the purge system of FIG. 1A.
Figure 31:
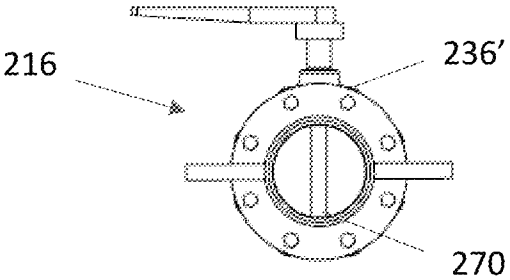
FIG. 31 is a front view of the coupling device of FIG. 28.
Figure 29:
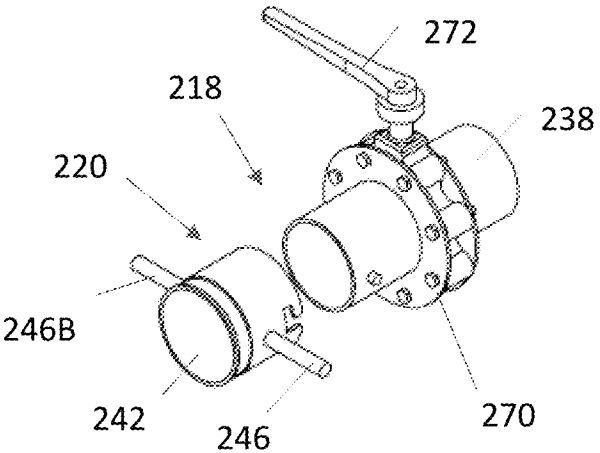
FIG. 29 is a front perspective view of the coupling device of FIG. 28.
Figure 34:
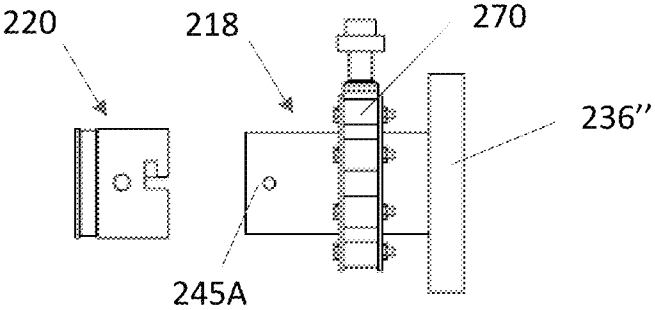
FIG. 34 is a side view of the coupling device of FIG. 32.
Figure 32:
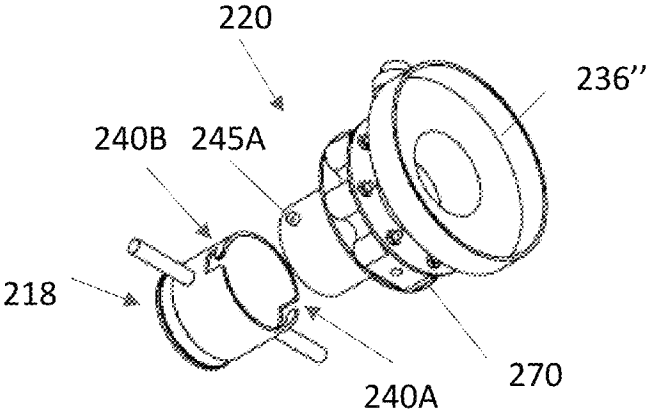
FIG. 32 is a rear perspective view of another exemplary embodiment of the coupling device in a decoupled position for the purge system of FIG. 1A.
Figure 35:
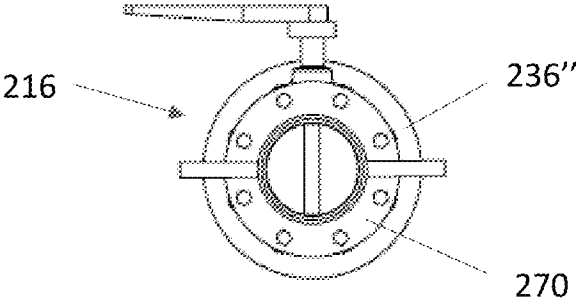
FIG. 35 is a front view of the coupling device of FIG. 32.
Figure 33:
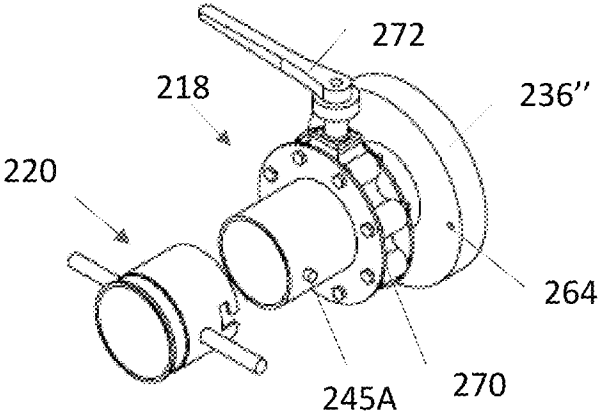
FIG. 33 is a front perspective view of the coupling device of FIG. 32.
Figure 39:
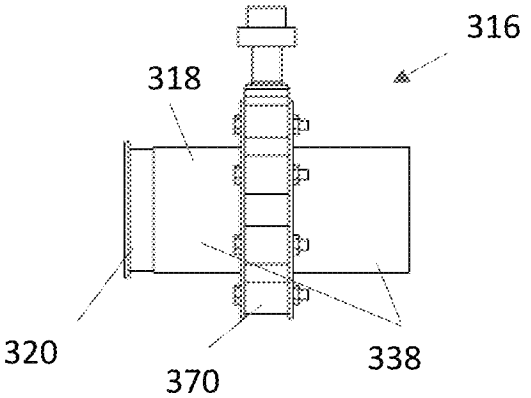
FIG. 39 is a side view of the coupling device of FIG. 36.
Figure 36:
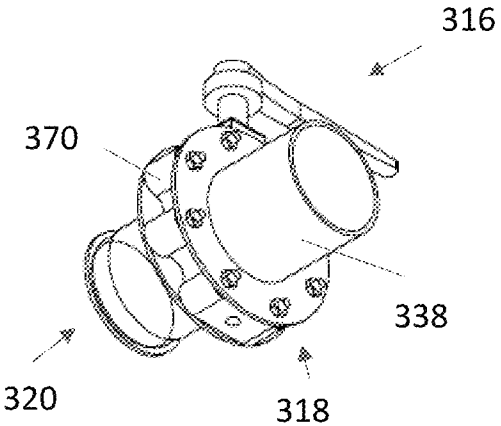
FIG. 36 is a rear perspective view of another exemplary embodiment of the coupling device in a coupled position for the purge system of FIG. 1A.
Figure 38:
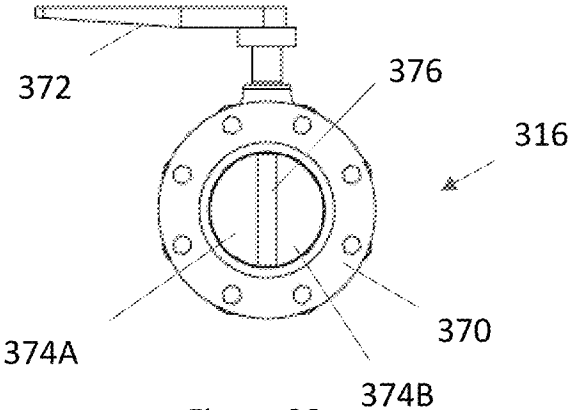
FIG. 38 is a front view of the coupling device of FIG. 36.
Figure 37:
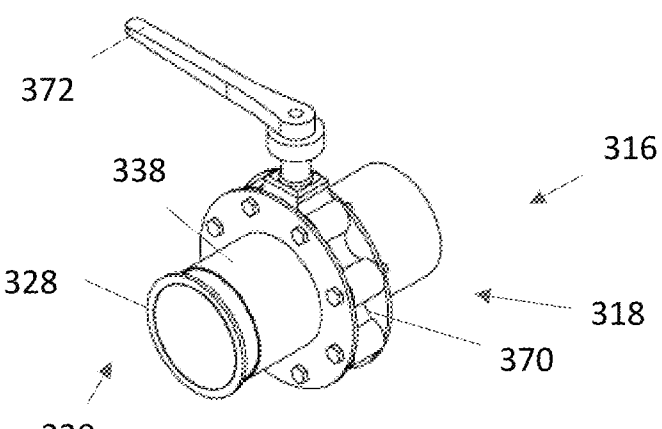
FIG. 37 is a front perspective view of the coupling device of FIG. 36.

As illustrated with particular regard to FIGS. 18-20, a cap 166 may be utilized with, or as part of, the coupling device 116. The cap 166 may be configured to fit atop an end of the first portion 118. The cap 116 may be configured to provide a friction fit, threaded fit, mate with the slots 140, or otherwise be selectively connected to one or more portions of the coupling device 116, combinations thereof, or the like. The cap 116 may provide a full or partial gaseous or particulate seal and/or protection from dust, debris, animal entry, combinations thereof, or the like.

The same or similar type cap 116 may be provided to fit atop an end of the second portion 116 in the same or a different manner.

While certain components shown and/or described herein may be shown and/or described as male or female, the reverse may be utilized. For example, without limitation, male components of the second portion 120 may instead by utilized in the first portion 118 and female components of the first portion 118 may instead be utilized in the second portion 120. By way of non-limiting example, the slots 140 may instead be provided in the second portion 120 and the protruding elements 146 may instead be provided in the first portion 118.

FIG. 21 through FIG. 35 illustrate other exemplary embodiments of the coupling device 216. Similar items may be numbered similarly but increased by multiples of 100 (e.g., 16 to 116 or 216, 18 to 118 or 218, etc.). The coupling device 216 may comprise the valve 270, though such is not required. The valve 270 may be located along the housing 238 of the first portion 218 in exemplary embodiments. The valve 270 may be positioned along any portion of the housing 238. The valve 270 may comprise a butterfly type valve with a shaft 276 and multiple discs 274A, 274B, though such is not required. The valve 270 may comprise one or more handles 272, such as but not limited to, levers, wheels, motors, drives, combinations thereof, or the like for manual or automatic actuation.

The second portion 220 may comprise a number of slots 240A, 240B. The slots 240 may be each configured to accommodate one of a number of posts 245A, 245B protruding from the first portion 218. In exemplary embodiments, a number of slots 240 may be provided equal to the number of posts 245, such as on a one-to-one basis, though such is not required. Each of the slots 240, in exemplary embodiments, may comprise a first portion 241A, 241B extending axially, such as along a longitudinal axis of the second portion 220, and a second portion 243A, 243B extending along an outer surface of the housing 238, such as circumferentially, so as to permit frictional securement of the posts 245 within the slots 240 when the posts 245 are inserted within the slots 240 and the second portion 220 is rotated or otherwise moved relative to the first portion 218 so that the posts 245 are positioned within the second portions 243 of the slots 240. The first portion 241 of the slots 240 may permit the second portion 220 to be inserted into the first portion 218 a distance, and the second portion 243 of the slots 240 may permit the second portion 220 to be secured to the first portion 218 such as to frictionally limit or prevent outward movement while so positioned.

The coupling device 216 may comprise the protruding elements 246, which may be used as handles to manipulate the second portion 220 in exemplary embodiments. First and second protruding elements 246A, 246B may be provided in exemplary embodiments on opposing sides of the housing 242 for the second portion 220.

Referring additionally to FIG. 24 through FIG. 27 and FIG. 32 through FIG. 35, the coupling device 216 may comprise any number or type of container adapters 236 configured to be mounted to, mate with, form part of, replace part of, combinations thereof, or the like, corresponding portions of the container 12. The container adapters 236 may comprise one or more apertures 264, such for gas probes, relief valves, sensors 32, fasteners, combinations thereof, or the like. Different embodiments of the container adapters 236 may be numbered similarly but with the addition of a single, double, etc. prime symbol (') (e.g., 236 to 236' to 236", etc.).

Referring additionally to FIG. 28 through FIG. 31, the coupling device 216 need not necessarily comprise a separate container adapter 236. Instead, the housing 238 of the first portion 218 may be extended and/or inserted through a wall in the container 12, for example, to place the coupling device 216 in fluid communication with the interior space 17.

FIG. 36 through FIG. 39 illustrate other exemplary embodiments of the coupling device 316. Similar items may be numbered similarly but increased by multiples of 100 (e.g., 16 to 116, 216, or 316, 18 to 118, 218, or 318, etc.). The coupling device 316 may comprise the valve 370, though such is not required. The valve 370 may be located along the housing 338 of the first portion 318 in exemplary embodiments. The valve 370 may be positioned along any portion of the housing 238. The valve 370 may comprise a butterfly type valve with a shaft 376 and multiple discs 374A, 374B, though such is not required. Any type, kind, or number of valves 370 may be utilized. The valve 370 may comprise one or more handles 372, such as but not limited to, levers, wheels, combinations thereof, or the like for manual or automatic actuation. For example, without limitation, the valve 370 may comprise, or be connected to, one or more motors, gears, linkages, drive belts, combinations thereof, or the like for automatically or manually manipulating the handle 372 and/or other component of the valve 370, such as but not limited to the shaft 376, to move the valve 370 between opened and closed positions.

The housing 328 of the second portion 320 may be configured to fit within at least a portion of the housing 338 of the first portion 318. Alternatively, the housing 338 of the first portion 318 may be configured to fit within at least a portion of the housing 328 of the second portion 320. The first and second portions 318, 320 may be sized for a snug fit.

Securement of the first portion 318 to the second portion 320 may be provided by friction fit, press fit, threads, pins or fasteners passing through the two housings 338, 328, combinations thereof, or the like. In this manner, the slots 40, 140, 240, the protrusions 46, 146, 246, and/or posts 245 may not be required.

Any embodiment of the present invention may include any of the features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

Certain operations described herein may be performed by one or more electronic devices. Each electronic device may comprise one or more processors, electronic storage devices, executable software instructions, and the like configured to perform the operations described herein. The electronic devices may be general purpose computers or specialized computing devices. The electronic devices may comprise personal computers, smartphones, tablets, databases, servers, or the like. The electronic connections and transmissions described herein may be accomplished by wired or wireless means. The computerized hardware, software, components, systems, steps, methods, and/or processes described herein may serve to improve the speed of the computerized hardware, software, systems, steps, methods, and/or processes described herein.

What is claimed is:

1. An apparatus for purging smoke and other gasses from an interior of a container, said apparatus comprising:

a coupling device comprising:

a first portion for fixing to the container and comprising a first housing defining a first inner passageway; and a second portion comprising a second housing defining a second inner passageway, wherein said second portion is selectively securable to said first portion to create a fluid passageway from the interior of the container, through the first inner passageway and the second inner passageway, to an ambient environment outside of the container; and a diaphragm located at the inner passageway of said first portion, wherein said diaphragm is biased in a closed position when said second portion is removed from said first portion so as to obstruct said inner passageway of said first portion and is moved into an opened position upon securement of said second portion to said first portion so as to create the fluid passageway through the coupling device.

2. The apparatus of claim 1 wherein:

the second housing fits within the first housing.

3. The apparatus of claim 1 further comprising:

a protrusion extending from said second portion for frictionally engaging and moving said diaphragm from said closed position into said opened position when said second portion is secured to said first portion;

a shaft extending from a sealing portion of said diaphragm;

one or more protruding members extending from a distal end of said shaft;

a support extending within said first portion configured to accommodate the shaft; and a spring extending along at least a portion of said shaft between said support and one or more protruding members, wherein said spring biases said diaphragm in said closed position.

4. The apparatus of claim 1 further comprising:

one or more protruding elements extending outward from a surface of said second portion; and one or more slots located within a surface of said first portion, each configured to accommodate one of said one or more protruding elements.

5. The apparatus of claim 4 wherein:

a first portion of said one or more slots extends along a longitudinal axis of said inner passageway of said first portion; and a second portion of said one or more slots extends along a perimeter of an outer surface of said first portion.

6. The apparatus of claim 1 further comprising:

a valve having a sealing portion located within the inner passageway of said first portion and a handle extending outside of said inner passageway of said first portion, wherein said sealing portion of said valve is moveable between a closed position where said inner passageway of said first portion is blocked and an opened position where said fluid passageway is created, and wherein movement of said sealing portion between said closed position and said opened position is accomplished by way of physical manipulation of said handle.

7. The apparatus of claim 6 wherein:

said valve comprises a butterfly valve.

8. The apparatus of claim 1 further comprising:

one or more posts extending from an outer surface of said first portion;

one or more slots located within an outer surface of said second portion, each configured to accommodate one of said one or more posts, wherein a first portion of said one or more slots extends along a longitudinal axis of said inner passageway of said second portion, and wherein a second portion of said one or more slots extends along a perimeter of an outer surface of said second portion; and one or more protruding elements extending from the outer surface of the second portion for physical manipulation of said second portion.

9. The apparatus of claim 1 wherein:

said first portion comprises:

a plate for fixing to a sidewall of the container; and a port located at the plate and configured to accommodate a gas probe.

10. The apparatus of claim 1 further comprising:

flexible ductwork connected to a distal end of said second portion for extending the fluid passageway; and an airflow device connected to a distal end of said flexible ductwork and comprising one or more fans configured to forcibly purge said smoke and other gasses from said container when activated.

11. The apparatus of claim 10 further comprising:

a controller in electronic communication with said one or more fans; and one or more sensors in electronic communication with said controller, said one or more sensors comprising one or more of a temperature sensor, a pressure sensor, and a smoke detector, wherein said controller is configured to command operation of said one or more fans based, at least in part, on data received from said one or more sensors.

12. The apparatus of claim 1 wherein:

the container comprises a shipping container and the first portion of the coupling device is configured for integration with a sidewall of the shipping container.

13. The apparatus of claim 1 wherein:

the container comprises a room of a building and the first portion of the coupling device is configured for fixing to a wall of the room.

14. An apparatus for purging smoke and other gasses from an interior of a container, said apparatus comprising:

a coupling device comprising:

a first portion for fixing to the container and comprising a first housing defining a first inner passageway; and a second portion comprising a second housing defining a second inner passageway, wherein said second portion is selectively securable to said first portion to create a fluid passageway from the interior of the container, through the first inner passageway and the second inner passageway, to an ambient environment outside of the container; and a valve having a sealing portion located within the inner passageway of said first portion and a handle extending outside of said inner passageway of said first portion, wherein said sealing portion of said valve is moveable between a closed position where said inner passageway of said first portion is blocked and an opened position where said fluid passageway is created by physical manipulation of said handle.

15. An apparatus for purging smoke and other gasses from an interior of a container, said apparatus comprising:

a coupling device comprising:

a first portion for fixing to the container and comprising a first housing defining a first inner passageway;

a second portion comprising a second housing defining a second inner passageway, wherein said second portion is selectively securable to said first portion to create a fluid passageway from the interior of the container, through the first inner passageway and the second inner passageway, to an ambient environment outside of the container;

one or more posts extending from an outer surface of said first portion;

one or more slots located within an outer surface of said second portion, each configured to accommodate one of said one or more posts, wherein a first portion of said one or more slots extends along a longitudinal axis of said inner passageway of said second portion, and wherein a second portion of said one or more slots extends along a perimeter of an outer surface of said second portion; and one or more protruding elements extending from the outer surface of the second portion for physical manipulation of said second portion.

16. An apparatus for purging smoke and other gasses from an interior of a container, said apparatus comprising:

a coupling device comprising:

a first portion for fixing to the container and comprising a first housing defining a first inner passageway;

a second portion comprising a second housing defining a second inner passageway, wherein said second portion is selectively securable to said first portion to create a fluid passageway from the interior of the container, through the first inner passageway and the second inner passageway, to an ambient environment outside of the container;

flexible ductwork connected to a distal end of said second portion for extending the fluid passageway;

an airflow device connected to a distal end of said flexible ductwork and comprising one or more fans configured to forcibly purge said smoke and other gasses from said container when activated;

a controller in electronic communication with said one or more fans; and one or more sensors in electronic communication with said controller, said one or more sensors comprising one or more of a temperature sensor, a pressure sensor, and a smoke detector, wherein said controller is configured to command operation of said one or more fans based, at least in part, on data received from said one or more sensors.

* * * * *